United States Patent [19]

Koike

[11] Patent Number: 4,701,681

[45] Date of Patent: Oct. 20, 1987

[54] STARTING DEVICE FOR A TOY MOTOR USING AN ULTRASONIC WAVE SIGNAL

[75] Inventor: Eishi Koike, Sagamihara, Japan

[73] Assignee: Ozen Corporation, Tokyo, Japan

[21] Appl. No.: 875,199

[22] Filed: Jun. 17, 1986

[30] Foreign Application Priority Data

Jun. 28, 1985 [JP] Japan ..... 60-99792

[51] Int. Cl.[4] ..... A63H 30/02

[52] U.S. Cl. ..... 318/16; 446/454

[58] Field of Search ..... 318/16; 446/409, 410, 446/416, 456, 454; 310/322, 334; 455/151, 603, 617, 619

[56] References Cited

U.S. PATENT DOCUMENTS

| | | | |
|---|---|---|---|
| 3,733,530 | 5/1973 | Labart et al. | 318/16 |
| 3,832,691 | 8/1974 | Galler | 318/16 X |
| 4,160,253 | 7/1979 | Mabuchi et al. | 318/16 X |
| 4,391,224 | 7/1983 | Adler | 446/409 X |
| 4,405,924 | 9/1983 | Shinoda et al. | 455/603 X |
| 4,467,249 | 8/1984 | Swearingen | 318/16 X |
| 4,618,804 | 10/1986 | Iwasaki | 318/16 |

*Primary Examiner*—William M. Shoop, Jr.
*Assistant Examiner*—Bentsu Ro
*Attorney, Agent, or Firm*—Arnold S. Weintraub

[57] ABSTRACT

Disclosed is a starting device for a toy motor using an ultrasonic wave signal. The starting device comprises a transmitter external to the toy which generates an ultrasonic wave signal and a receiving and starting element disposed within the toy for receiving the transmitted ultrasonic wave signal and starting the toy motor. In a preferred embodiment, the motor drives a sound reproducing device. The ultrasonic wave signal from the transmitter is received, amplified, and detected, and when the detected output reaches a predetermined level, a switching transistor forming an energization path to the motor is turned on to start the motor. Once the motor is started, a self-holding switch associated with the switching transistor causes the switching transistor to supply continuous current to the motor even when the transmission of the ultrasonic wave signal has been terminated.

2 Claims, 3 Drawing Figures

STARTING DEVICE FOR A TOY MOTOR USING AN ULTRASONIC WAVE SIGNAL

BACKGROUND OF THE INVENTION

1. Field of the Invention

The present invention relates to a motor starting device to remotely control the starting of a motor incorporated in a toy by using an ultrasonic wave signal.

2. Description of the Prior Art

A prior art toy motor starting device is described, for example, in Japanese Utility Model Laid-Open Publication No. 60-49898 (1985).

In this prior art device, an external, audible, relatively loud sound is sensed by a sound-sensitive switch built in the toy, and the sensed signal is amplified to operate a motor driving circuit thereby to drive the toy motor for a pre-determined period of time.

However, in the prior art toy motor starting device, the toy motor is started by sensing an audible sound generated externally. If the sensitivity of the sound sensor is set at a high threshold to prevent faulty operation caused by extraneous noise, the toy motor can only be started by generating a loud sound, which may be annoying. On the other hand, in order to start the toy motor with a relatively soft sound, it is necessary to lower the threshold sensitivity of the sound sensor. In this case, the toy motor will be started by many extraneous sounds other than a generated sound intended by the user, and thus, it is impossible to srart the toy motor exactly as the user intends. Moreover, since the starting device is designed to sense external sound, it is difficult to srart the toy motor any appreciable distance away from the toy. Thus, the prior art toy motor starting device is unsatisfactory in some respects.

SUMMARY OF THE INVENTION

The present invention was made in view of the problems in the prior art toy starting device, and it is an object of the invention to provide a toy motor starting device using ultrasonic waves which is capable of starting a toy motor exactly as the user intends, and at the same time, which is capable of operating the toy motor from a distance away from the toy.

The herein disclosed invention is a starting device for a toy motor using an ultrasonic wave signal. The invention comprises: a transmitter for generating an ultrasonic wave signal; and a receiving and starting circuit for receiving the ultrasonic wave signal from the transmitter and for starting the motor for the toy. The receiving and starting circuit comprises: a receiving transducer for receiving the ultrasonic wave signal; an amplifier section connected to the receiving transducer for amplifying the received signal; a detection section connected to the output side of the amplifier section for supplying detected output; and a motor starting section connected to the detection section for energizing the motor in response to an output signal from the detection section.

In the present invention, the user transmits an ultrasonic wave from the transmitter which is received by the receiving and starting circuit built in the toy. The received signal is amplified and detected by the receiving and starting circuit, and a driving current is supplied to the toy motor based on the detected output to start the motor. Accordingly, the toy motor can be started when and only when the user intends and from any desired position.

DESCRIPTION OF THE PREFERRED EMBODIMENTS

The embodiments of the present invention will be described with reference to the drawings.

Figure 1:
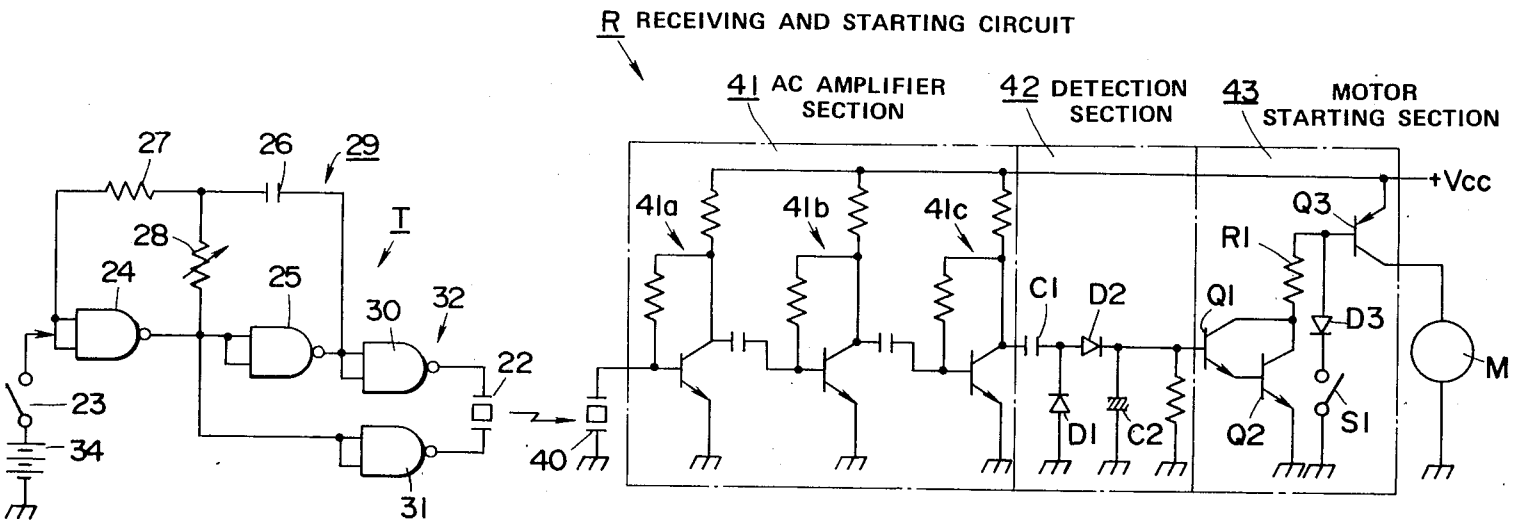
FIG. 1 is a circuit diagram of a toy motor starting device of an embodiment according to the present invention.
Figure 2:
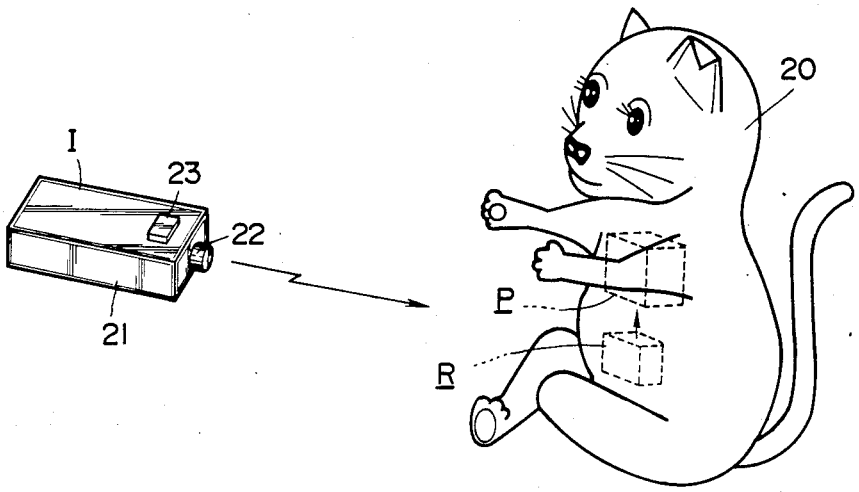
FIG. 2 is a perspective view showing the appearance of the toy motor starting device with a part thereof incorporated in a toy.

A toy motor starting device using ultrasonic waves in accordance with the present invention used to start a motor M will be described with reference to FIGS. 1 and 2. In FIG. 1, character T designates an ultrasonic wave transmitter, and character R designates a receiving and starting circuit built in a toy 20 as shown in FIG. 2. The ultrasonic wave transmitter T is formed, as shown in FIG. 2, such that a transducer 22 for transmitting an ultrasonic wave signal is provided on the front surface of a rectangular parallellepiped case body 21, and a push-button transmitter switch 23 of a conventional type for controlling the emission of the ultrasonic wave signal is provided on the upper surface of the case body 21.

An electric circuit of the ultrasonic wave transmitter T is arranged as shown in FIG. 1. The transmitter T circuit is comprised of an astable multivibrator 29 including a series circuit of NAND gates 24, 25, a series circuit of a capacitor 26 and a resistor 27 connected across the serially connected NAND gates 24, 25, and a variable resistor 28 connected between the junction point of the NAND gates 24, 25 and the junction point of the capacitor 26 and the resistor 27. The transmitter circuit is further comprised of a transducer driving circuit 32 including a NAND gate 30 having an input connected to the output of the NAND gate 25, a NAND gate 31 having an input connected to the junction point between the NAND gates 24 and 25, and a transmitting ultrasonic wave transducer 22 connected between the outputs of the NAND gates 30 and 31. The transmitter switch 23 is inserted in a power supply line for supplying DC power from a battery 34 to each of the NAND gates 24, 25, 30 and 31. The oscillation frequency of the astable multivibrator 29 is set to a selected ultrasonic wave frequency.

The receiving and starting circuit R shown in FIG. 1 is comprised of a receiving ultrasonic wave transducer 40 for receiving the ultrasonic wave signal from the ultrasonic wave transmitter T, an AC amplifier section 41 for amplifying the received output, a detection section 42 for detecting the amplified output, and a motor starting section 43 for starting the motor M.

The AC amplifier section 41 amplifies the received output from the receiving ultrasonic transducer 40 by R-C amplifier circuits 41*a*–41*c* connected in series.

The detection section 42 rectifies the AC amplified output from the AC amplifier section 41 by diodes D1, D2 through a DC blocking capacitor C1, and the rectified output is charged on a charging and discharging capacitor C2. A voltage across both terminals of the charging and discharging capacitor C2 is supplied as the detected output to the motor starting section 43.

The motor starting section 43 includes transistors Q1, Q2 connected in a Darlington fashion and inputted with the detected output, a PNP type transistor Q3 having a base connected to a collector of the transistor Q2 through a resistor R1, and a series circuit of a diode D3 and the self-holding switch S1 connected between the base of the transistor Q3 and a ground. The motor M is connected between the collector of the transistor Q3 and a ground.

An embodiment of the present invention further comprising a sound reproducing device P for a toy will be described with reference to FIG. 3.

Figure 3:
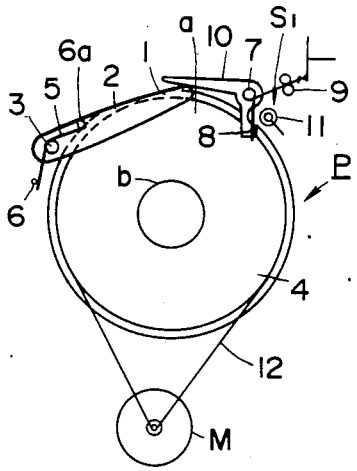
FIG. 3 is a schematic diagram of a sound reproducing device for a toy to which the present invention is applicable.

In FIG. 3, a pickup 1 is formed at the tip of a tone arm 2 as a part thereof, and at the lower surface of the tone arm 2, a reproducing stylus (not shown) is provided to protrude therefrom. A base end of the tone arm 2 is oscillatably supported by means of a pin 3 so that the tone arm 2 is allowed to move radially about the pin 3, allowing the reproducing stylus to move back and forth on a recording surface of a recording disk 4 between a reproduction starting point a and a reproduction ending point b, and also to move above the recording surface of the recording disk 4.

A wire-like return spring 5 is supported by the pin 3 with a middle portion of the return spring 5 wound around the pin 3. One end of the spring 5 extends along the upper surface of the tone arm 2 and is held by a protrusion 6*a* so as to press against the protrusion 6*a* in a direction away from the reproduction ending point b and towards the reproduction staring point a and at the same time to press upwardly against the protrusion 6*a*. The other end of the spring 5 is held by a post 6 fixed to a casing (not shown). In this way, the pickup 1 is always biased in a direction toward the reproduction starting point a and in a direction away from the recording surface of the recording disk 4.

A self-holding switch S1 includes a movable contact 8 formed by a spring wire material having a middle portion wound about a pin 7 fixed to the casing (not shown) and having a first end held by a post 9 fixed to the casing (not shown). A second end of the movable contact 8 is held by a lever 10 which is supported by the pin 7 coaxially of the moving contact 8. A fixed contact 11 is provided at a position opposed to an intermediate portion of the movable contact 8 between the first and second ends thereof. For the spring wire material of the movable contact 8, a highly elastic material is selected to enable it to contact the fixed contact 11 with sufficient pressure.

The lever 10 is generally in an L-shape, and is rotatably supported at the bent portion by the pin 7. A first end of the lever 10 forms a hook to hold the secone end of the movable contact 8, and a second end of the lever 10 is proximate the reproduction starting point a on the recording disk 4 and is always biased towards the reproduction ending point b on the recording disk 4 by the movable contact 8. Further, a portion of the lever 10 between the first end thereof and the pin 7 is biased to contact with the fixed contact 11.

The second end of the lever 10 is, accordingly, disposed so that the pickup 1 abuts against a side of the recording disk 4 located in a direction toward the reproduction ending point b. The length of the arm of the L-shape of the lever 10 between the second end is longer than the length of the base of the L-shape of lever 10 between the first end and the pin 7. The length of the arm lever 10 is selected to produce a moment of force sufficiently greater than that of the elasticity of the movable contact 8.

Further, the recording disk 4 is coupled to motor M through a belt 12, and is driven to rotate by the rotation of the motor M.

Although it is not shown in the drawing, a stylus pressure spring for applying a suitable pressure to the pickup 1 and a suitable means for releasing the stylus pressure are provided such that the reproducing stylus is made to engage a recording groove of the recording disk 4 until the pickup 1 reaches the reproduction ending point b from the reproduction starting point a. Upon reaching the reproduction ending point b, the reproducing stylus of the pickup 1 is moved away from the recording groove and the tone arm 2 is returned to the position of the reproduction starting point a by the return spring 5. Such mechanisms are familiar to those skilled in the art.

In operation, when the pickup 1 is at the reproduction starting position, the tone arm 2 is abutting against the lever 10, and the movable contact 8 of the self-holding switch S1 is apart from the fixed contact 11 and thereby in an OFF condition. Further, it is assumed that the transmitter switch 23 of the ultrasonic wave transmitter T is in an OFF condition, that the astable multivibrator 29 and the transducer driving circuit 32 are in a non-operating condition, and that an ultrasonic wave signal is not being transmitted from the transmitting ultrasonic wave transducer 22.

In this condition, no received output is supplied from the receiving ultrasonic wave transducer 40 of the receiving and starting circuit R, and since there is no output from the AC amplifier section 41, the charging and discharging capacitor C2 in the detection section 42 is in a discharged condition. Accordingly, the transistors Q1–Q3 in the motor starting section 43 are in an OFF condition, and since the energization path to the motor M is interrupted, the motor M is in a stationary condition.

When the transmitter switch 23 of the ultrasonic wave transmitter T is turned ON, DC power is supplied from the battery 34 to the astable multivibrator 29 and the transducer driving circuit 32, and these members become operational. An oscillation output at a preset ultrasonic frequency is obtained from the astable multivibrator 29, and this output is supplied to the transducer driving circuit 32. As a result, an ultrasonic wave signal is transmitted from the transmitting ultrasonic wave transducer 22.

When this signal is received by the receiving ultrasonic wave transducer 40 in the receiving and starting circuit R, it is amplified in the AC amplifier section 41, and the amplified output is supplied to the detection section 42. In the detection section 42, the amplified AC output is rectified by the diodes D1, D2, and the rectified output is charged on the charging and discharging capacitor C2.

When the charged potential is sufficient to turn ON transistor Q1 in the motor starting section 43 transistors Q2 and Q3 are also turned ON, motor M is energized and thereby starts to rotate.

Due to the rotation of the motor M, the recording disk 4 is also driven in rotation by the belt 12, and a sound signal recorded in the recording groove is reproduced by the pickup 1 which is in engagement with the recording groove, and the reproduced signal is transmitted to a speaker (not shown) to produce sounds.

When the sound signal is generated by the pickup 1, the tone arm 2 is turned in a clockwise direction, and disengaged from the lever 10. Lever 10 is thereby turned in a counter-clockwise direction due to the elasticity of the movable contact 8, and the movable contact 8 is brought into contact with the fixed contact 11, and thus, the self holding switch S1 turns ON. As a result, the base of the transistor Q3 in the motor starting section 43 is grounded through the diode D3 and the self-holding switch S1 and remains in the ON condition, and the energization of the motor M is continued.

Accordingly, even when the ultrasonic wave signal is transmitted from the ultrasonic wave transmitter T for only a short time, the mechanism is activated provided the charging and discharging capacitor C2 is allowed to be charged to a potential which is sufficient to turn ON the transistor Q1. For example, about one second is generally sufficient.

When the pickup 1 moves along the recording groove on the recording disk 4 and reaches the reproduction ending point b, the pickup 1 is moved by a cam mechanism (not shown) away from the recroding groove on the recording disk 4 and the reproduction of the recording disk 4 is completed. At the same time, the tone arm 2 is returned to the reproduction starting point a. Due to the return of the tone arm 2, since the lever 10 is turned in a clockwise direction against the elasticity of the movable contact 8, the movable contact 8 is moved away from the fixed contract 11 and the self-holding switch S1 is placed in the OFF condition. Consequently, since the transistor Q3 in the motor starting section 43 is turned OFF, the energization path to the motor M is interrupted and the motor M is stopped.

The sound reproduction operation described above is repeated each time an ultrasonic wave signal is transmitted from the ultrasonic wave transmitter T.

While in the above embodiment describes the case in which the self-holding switch S1 in the motor starting section 43 is inserted between the base of the transistor Q3 and a ground, the connection of the self-holding switch S1 is not restricted to the above-mentioned case. The self holding switch S1 may be inserted, for example, between the base of the transistor Q1 and a DC power supply, or may be connected in parallel with the transistor Q3.

Further, in the above embodiment, the motor of the present invention is applied to rotate the recording disk 4, thereby producing a remote controlled sound making toy. However, the invention is not restricted to this embodiment and is applicable to any motor for toys, such as for example, a motor for driving the hands and feet of a toy, a motor for driving a toy to travel, or the like.

The present invention has been described according to certain embodiments and exemplifications, but it is not intended to be limited thereby but solely by the claims appended hereto.

I claim:

1. A starting device for a toy motor using an ultrasonic wave signal comprising:

a transmitter for generating an ultrasonic wave signal; and a receiving and starting circuit for receiving the ultrasonic wave signal from said transmitter and for starting said toy motor, said receiving and starting circuit including:

a receiving transducer for receiving said ultrasonic wave signal;

an amplifier section connected to said receiving transducer for amplifying the received signal including R-C amplifier circuits;

a detection section connected to the output of said amplifier section for generating a detected output signal including diode rectifiers and charging-discharging capacitor; and a motor starting section connected to said detection section for energizing said motor in response to an output signal from said detection section.

2. A starting device according to claim 1, wherein said motor starting section further comprises:

a switching element for supplying a driving current to said toy motor in response to a detected output signal from said detection section; and a self-holding switch associated with said switching element for supplying a continuous supply of driving current to said toy motor for a predetermined period of time.

* * * * *